US009076380B2

(12) United States Patent
Guo et al.

(10) Patent No.: US 9,076,380 B2
(45) Date of Patent: Jul. 7, 2015

(54) PIXEL DRIVING CIRUCIT, PIXEL DRIVING METHODS, DISPLAY PANELS AND ELECTRONIC DEVICES

(71) Applicants: INNOCOM TECHNOLOGY (SHENZHEN) CO., LTD., Longhua Town, Bao An District, Shenzhen, Guangdong Province (CN); Chimei InnoLux Corporation, Miao-Li County (TW)

(72) Inventors: Hong-Ru Guo, Miao-Li County (TW); Lien-Hsiang Chen, Miao-Li County (TW)

(73) Assignees: INNOCOM TECHNOLOGY (SHENZHEN) CO., LTD., Longhua Town, Shenzhen (CN); INNOLUX CORPORATION, Miao-Li County (TW)

( * ) Notice: Subject to any disclaimer, the term of this patent is extended or adjusted under 35 U.S.C. 154(b) by 199 days.

(21) Appl. No.: 13/726,841

(22) Filed: Dec. 26, 2012

(65) Prior Publication Data

US 2014/0022152 A1 Jan. 23, 2014

(30) Foreign Application Priority Data

Jul. 19, 2012 (TW) ..... 101125969 A

(51) Int. Cl.
*G09G 3/32* (2006.01)
*G09G 3/30* (2006.01)

(52) U.S. Cl.
CPC ..... *G09G 3/3208* (2013.01); *G09G 3/30* (2013.01); *G09G 2300/0439* (2013.01); *G09G 3/3233* (2013.01); *G09G 2300/0814* (2013.01); *G09G 2300/0819* (2013.01); *G09G 2320/045* (2013.01)

(58) Field of Classification Search
CPC ..... G09G 3/3233; G09G 2320/043; G09G 2310/0251; G09G 2300/0819; G09G 2300/0842; G09G 2300/0852; G09G 3/30–3/3291
USPC ..... 345/76, 82, 211
See application file for complete search history.

(56) References Cited

U.S. PATENT DOCUMENTS 8,665,185 B2 * 3/2014 Fan et al. ..... 345/76
2005/0116967 A1 * 6/2005 Shirasaki et al. ..... 345/690

(Continued)

FOREIGN PATENT DOCUMENTS

CN 101996579 3/2011

OTHER PUBLICATIONS

Chinese language office action dated Mar. 2, 2015, issued in application No. 201210251232.5.

*Primary Examiner* — Temesgh Ghebretinsae
*Assistant Examiner* — Michael J Jansen, II
(74) *Attorney, Agent, or Firm* — McClure, Qualey & Rodack, LLP

(57) ABSTRACT

A pixel driving circuit is provided, including first, second, third, fourth, and fifth switching devices and first and second capacitors. The first switching device has a first terminal coupled to a first power source voltage, and a control terminal coupled to a first scan signal line. The second switching device has a first terminal coupled to a second terminal of the first switching device, a second terminal coupled to a first node and an emitting device, and a control terminal coupled to a second node. The third switching device has a first terminal coupled between the first terminal of the second switching device and a second terminal of the first switching device, a second terminal coupled to the second node, and a control terminal coupled to a second scan signal line.

19 Claims, 8 Drawing Sheets

(56) References Cited

U.S. PATENT DOCUMENTS

| | | | | |
|---|---|---|---|---|
| 2006/0066532 | A1* | 3/2006 | Jeong | 345/76 |
| 2006/0077134 | A1* | 4/2006 | Hector et al. | 345/76 |
| 2006/0238461 | A1* | 10/2006 | Goh et al. | 345/76 |
| 2007/0103419 | A1* | 5/2007 | Uchino et al. | 345/92 |
| 2008/0074362 | A1* | 3/2008 | Ogura | 345/77 |
| 2009/0096721 | A1* | 4/2009 | Chiou et al. | 345/76 |
| 2010/0066714 | A1* | 3/2010 | Ozaki | 345/207 |
| 2010/0194716 | A1* | 8/2010 | Park | 345/204 |
| 2011/0084947 | A1* | 4/2011 | Chung et al. | 345/211 |
| 2011/0227906 | A1* | 9/2011 | Shirasaki et al. | 345/212 |
| 2012/0162175 | A1* | 6/2012 | Fan et al. | 345/211 |
| 2013/0207957 | A1* | 8/2013 | Lin et al. | 345/212 |

* cited by examiner

PIXEL DRIVING CIRUCIT, PIXEL DRIVING METHODS, DISPLAY PANELS AND ELECTRONIC DEVICES

CROSS REFERENCE TO RELATED APPLICATIONS

This Application claims priority of Taiwan Patent Application No. 101125969, filed on Jul. 19, 2012, the entirety of which is incorporated by reference herein.

BACKGROUND OF THE INVENTION

1. Field of the Invention

The present invention relates to panel displays, and in particular to pixel driving circuits.

2. Description of the Related Art

In a pixel of an organic light-emitting diode (OLED) display, charges are stored in a storage capacitor for controlling the luminance of an OLED via a thin-film transistor (TFT). Referring to FIG. 1, a schematic diagram of a conventional pixel circuit is shown. The pixel circuit 100 includes an N-type TFT 102, a storage capacitor 104 and an OLED 106. The two ends of the storage capacitor 104 are respectively coupled to the gate G and the source S of the TFT 102. The voltage drop of the storage capacitor 104 is denoted by Vgs. The positive end of the OLED 106 is coupled to the source S of the TFT 102, whose voltage level is denoted by VOLED. The current flowing by the TFT 102 is controlled by the voltage drop Vgs, with the current IOLED of the OLED 106 being equal to K*(Vgs−VTH).sup.2. The voltage drop Vgs is the voltage difference between the pixel voltage Vdata and the voltage level VOLED at the positive end of the OLED 106. Therefore, the luminance of the OLED 106 can be controlled by adjusting the pixel voltage Vdata.

However, when the above-mentioned TFT 102 is operating, a shift of the threshold voltage occurs on the TFT 102. The amount of voltage shift is related to the manufacturing process, operation time, and the current of the TFT 102. Therefore, in terms of all pixels on the display panel, due to the difference of the pixels in the operation time, conductive current, and manufacturing process, the amount of shift of the threshold voltage of each pixel is different, which in turn causes the luminance and the received pixel voltage of each pixel to have a different corresponding relationship. Therefore, the issue of non-uniform frame luminance occurs.

In addition, the OLED 106 has an increasing voltage drop, which is an increasing VOLED, along with the usage time. Referring to FIG. 2, a characteristic diagram of the OLED 106 is shown. From FIG. 2, it can be seen that the OLED 106 has an increasing VOLED under a long usage time. Therefore, the conductive current IOLED is reduced under the long usage time according to the equation Vgs=Vdata−VOLED. The decreasing current IOLED causes the pixel voltage Vdata to be unable to drive the OLED 106 to reach the predetermined luminance. Thus the overall luminance of the display frame is reduced.

There is therefore a need for a pixel driving circuit and a pixel driving method thereof to solve the variation of the thin-film transistors (TFT) and the aging of the OLED 106.

BRIEF SUMMARY OF THE INVENTION

In light of the problems described above, the invention provides an embodiment of a pixel driving circuit, including first, second, third, fourth, and fifth switching devices and first and second capacitors. The first switching device has a first terminal coupled to a first power source voltage, and a control terminal coupled to a first scan signal line. The second switching device has a first terminal coupled to a second terminal of the first switching device, a second terminal coupled to a first node and an emitting device, and a control terminal coupled to a second node. The third switching device has a first terminal coupled between the first terminal of the second switching device and a second terminal of the first switching device, a second terminal coupled to the second node, and a control terminal coupled to a second scan signal line. The fourth switching device has a first terminal coupled to a data signal line, a second terminal coupled to the first node, and a control terminal coupled to a third scan signal line. The first and second capacitors are coupled in series between the first and second nodes. The fifth switching device has a first terminal coupled between the first and second capacitors, a second terminal coupled to a second power source voltage, and a control terminal coupled to the third scan signal line.

The disclosure also provides a pixel driving method applied to the pixel driving circuit. The pixel driving method includes the steps of: respectively discharging the first and second nodes to a reference voltage and a compensation voltage through the second, third and fourth switching devices in a compensation stage, wherein the compensation voltage is the sum of the reference voltage and a threshold voltage of the second switching device; loading a data signal into the first node through the fourth switching device according to a third scan signal output from the third scan signal line in a data input stage later than the compensation stage, wherein the data signal is a negative voltage; and delivering the data signal to the second node by the first and second capacitors in an emission stage later than the data input stage, such that the second switching device generates a driving current to the emitting device according to the voltage level of the second node.

The disclosure also provides a display panel including a pixel driving circuit. The pixel driving circuit includes first, second, third, fourth, and fifth switching devices and first and second capacitors as described above.

The disclosure also provides an electronic device having the display panel described above and a power supply. The power supply provides power to the display panel.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
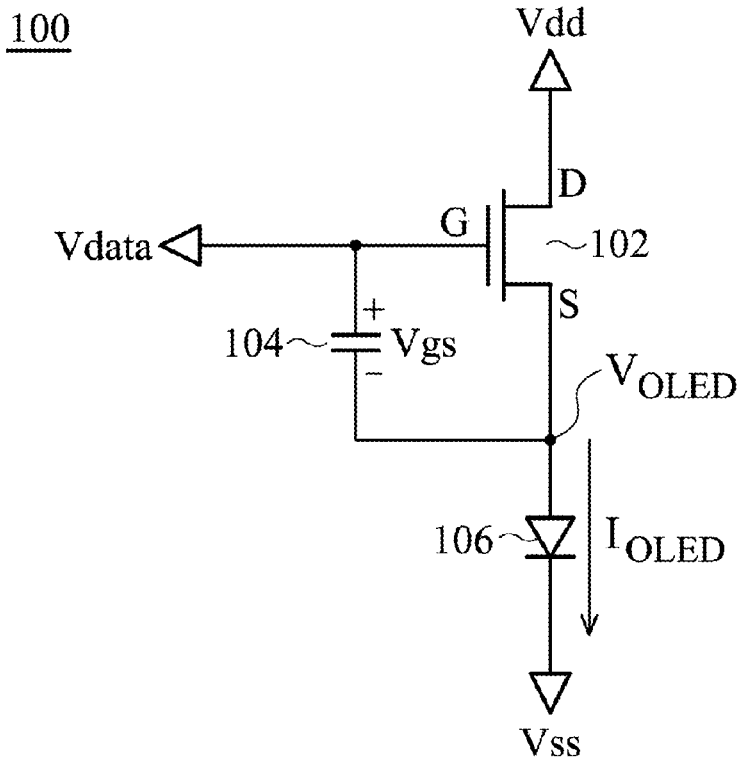
FIG. 1 ( PRIOR ART )
FIG. 1 is a schematic diagram of a conventional pixel circuit.
Figure 2:
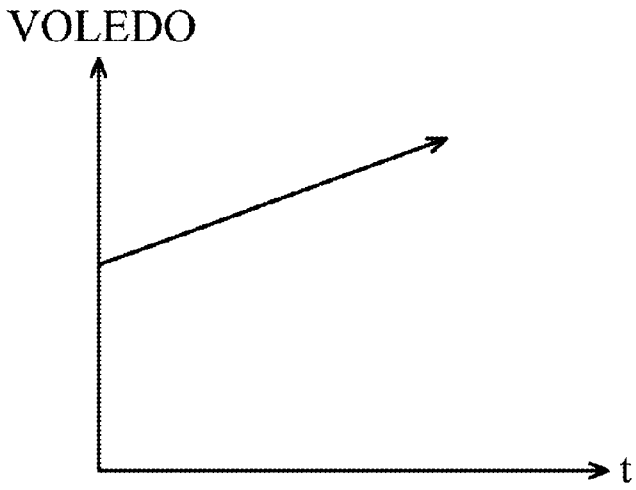
FIG. 2 ( PRIOR ART )
FIG. 2 is a characteristic diagram of the OLED.
Figure 3:
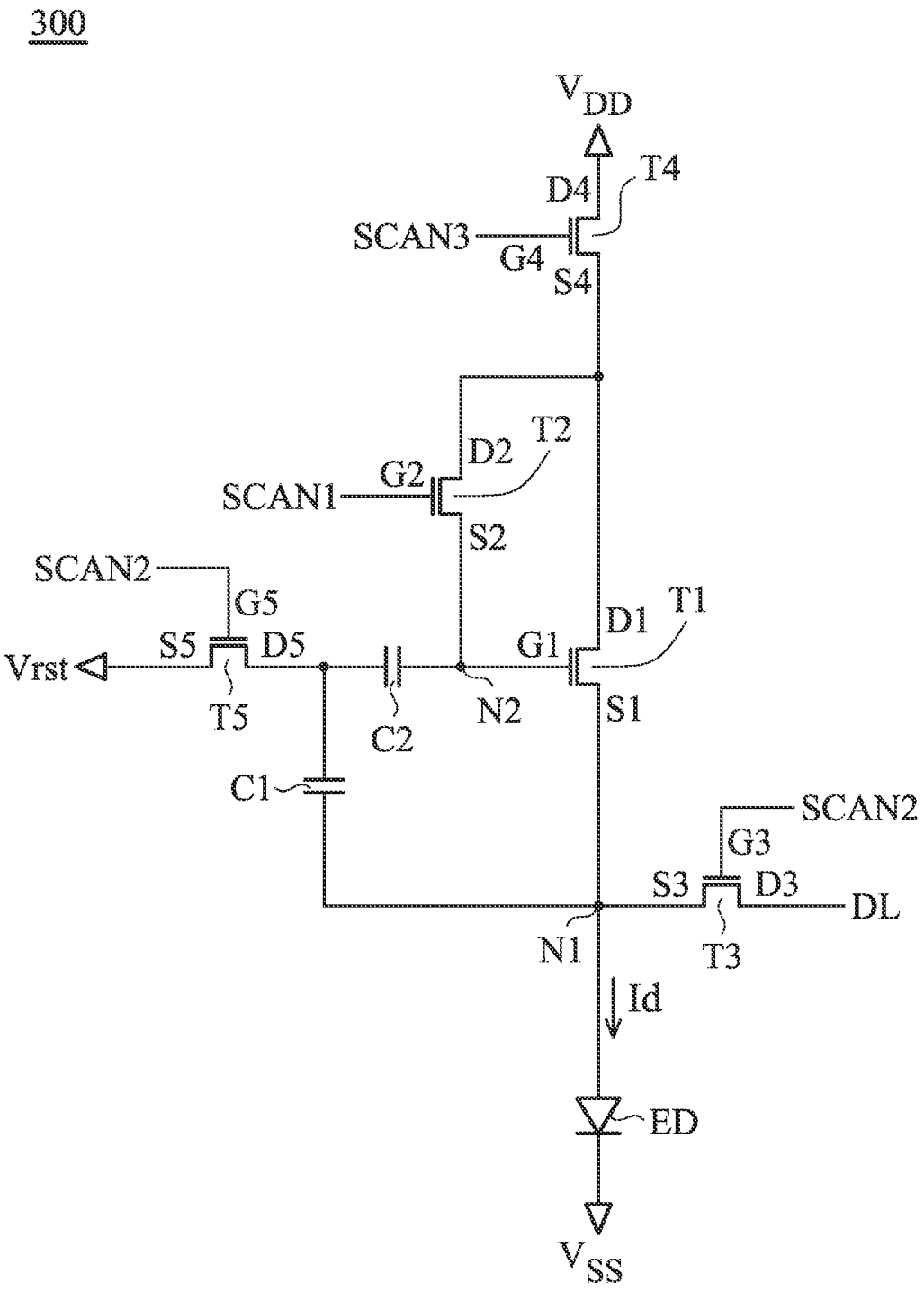
FIG. 3 illustrates an embodiment of the pixel driving circuit.

FIG. 3 illustrates an embodiment of the pixel driving circuit. As shown in FIG. 3, the pixel driving circuit 300 is configured to generate a driving current Id to an emitting device ED, such that the emitting device ED emits according to the driving current Id. In the embodiment, the emitting device ED is an organic light-emitting diode (OLED). The pixel driving circuit 300 includes switching devices T1~T5 and capacitors C1~C2. In the embodiment, the switching devices T1~T5 can be amorphous silicon thin-film transistors (a-Si TFT) or InGaZnO thin-film transistors (IGZO TFT), but are not limited thereto. Each of the switching devices T1~T5 can be implemented by any of various kinds of N-type thin-film transistors.

In detail, the switching device T4 has a first terminal D4 coupled to a power source voltage VDD, and a control terminal G4 coupled to a scan signal line SCAN3. The switching device T1 has a first terminal D1 coupled to the second terminal S4 of the switching device T4, a second terminal S1 coupled to a node N1 and the emitting device ED, and a control terminal G1 coupled to a node N2. The switching device T2 has a first terminal D2 coupled between the first terminal D1 of the switching device T1 and the second terminal S4 of the switching device T4, a second terminal S2 coupled to the node N2, and the control terminal G2 coupled to a scan signal line SCAN1. The switching device T3 has a first terminal D3 coupled to a data signal line DL, a second terminal S3 coupled to the node N1, and a control terminal G3 coupled to a scan signal line SCAN2. The capacitors C1 and C2 are coupled in series between the nodes N1 and N2. The switching device T5 has a first terminal D5 coupled between the capacitors C1 and C2, a second terminal S5 coupled to a power source voltage Vrst, and a control terminal G5 coupled to the scan signal line SCAN2. The power source voltage Vrst can be any level.

Figure 4:
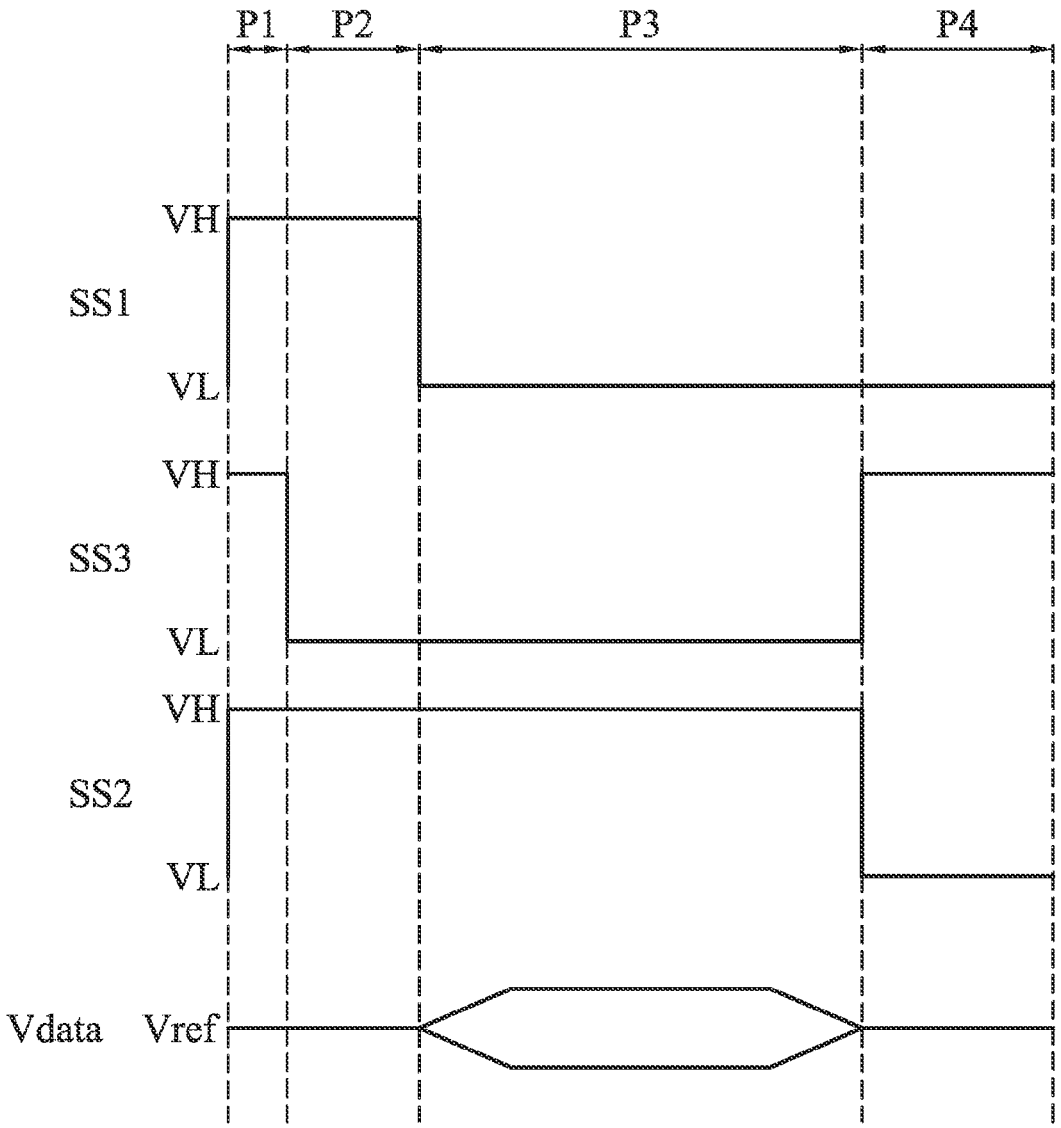
FIG. 4 illustrates the timing chart of the data signal Vdata and the scan signals SS1, SS2, SS3, and SS4 of the disclosure.

FIG. 4 illustrates a timing chart of the data signal Vdata and the scan signals SS1, SS2, and SS3 of the disclosure in order to illustrate the operation of the pixel driving circuit 300. As shown in FIGS. 3 and 4, a frame period sequentially includes a reset stage P1, a compensation stage P2, a data input stage P3, and an emission stage P4. In the reset stage P1, the switching devices T1~T5 operate in an on-state according to the scan signals SS3, SS1, and SS2 output respectively from the scan signal lines SCAN3, SCAN1, and SCAN2, such that the switching devices T4 and T2 charge the node N2 to a high voltage level VH by to the power source voltage VDD.

In the compensation stage P2 later than the reset stage P1, the switching devices T2, T3, and T5 operate in the on-state according to the scan signals SS1 and SS2, and the switching device T4 operates in the off-state according to the scan signal SS3, such that the switching device T1 operates in a diode connection state, and the nodes N1 and N2 are respectively discharged to a reference voltage Vref and a compensation voltage Vcp by switching devices T2 and T3, in which the compensation voltage Vcp is the sum of the reference voltage Vref and a threshold voltage Vth of the switching device T1 (Vcp=Vref+Vth). In addition, the reference voltage Vref is larger than the maximum gray scale voltage, and Vref<Vss+VOLED0, in which VOLED0 represents the threshold voltage of the emitting device ED, and Vss represents the level of the ground terminal.

In the data input stage P3 later than the compensation stage P2, the switching devices T3 and T5 operate in the on-state according to the scan signals SS2, and the switching devices T4, T1, and T2 operate in the off-state according to the scan signals SS3 and SS1, such that the switching device T3 loads the data signal Vdata into the node N1. Note that the data signal Vdata is a negative voltage, such that the emitting device ED can not be turned on since the node N1 feeds a negative bias to the emitting device ED.

In the emitting stage P4 later than the data input stage P3, the switching devices T2, T3, and T5 operate in the off-state according to the scan signals SS1 and SS2, and the switching device T4 operates in the on-state according to the scan signal SS3, such that the data signal Vdata is delivered to the node N2 by the capacitors C1 and C2. Therefore, the switching device T1 operates in a saturation state and generates the driving current Id to the emitting device ED according to the voltage level of the node N2.

In detail, when the emitting device ED operates in the on-state, the voltage level of the node N1 is changed from the data signal Vdata to the threshold voltage VOLED1, and the voltage level of the node N2 is changed from the compensation voltage Vcp to a first level V1 due to the voltage continuity of a capacitor at both ends, in which V1=Vref+Vth+VOLED1-Vdata. Therefore, the gate-source voltage of the switching device T1 can be described as follows:

$$Vgs = V1 - VOLED1 = (Vref + Vth + VOLED1 - Vdata) - VOLED1 = Vref - Vdata + Vth.$$

Since Vgs (the gate-source voltage of the switching device T1)>Vth and Vds (the drain-source voltage of the switching device T1)>(Vgs−Vth), the switching device T1 operates in the saturation state, and the driving current Id is only dependent on the gate voltage of the switching device T1. The description of the driving current Id is shown in the following:

$$\begin{aligned} Id &= K(Vgs - Vth)^2 \\ &= K[Vref - Vdata + Vth - Vth]^2 \\ &= K[Vref - Vdata]^2. \end{aligned}$$

K represents the gain coefficient of the transistors. Obviously, when the emitting device ED operates in the on-state, the driving current Id is independent of the threshold voltage Vth of the switching device T1 and the open circuit threshold voltage VOLED1 of the emitting device ED. Therefore, the brightness uniformity of the pixel driving circuits 300 can not be generated by variations in the threshold voltage of the transistors and the emitting device.

Figure 5:
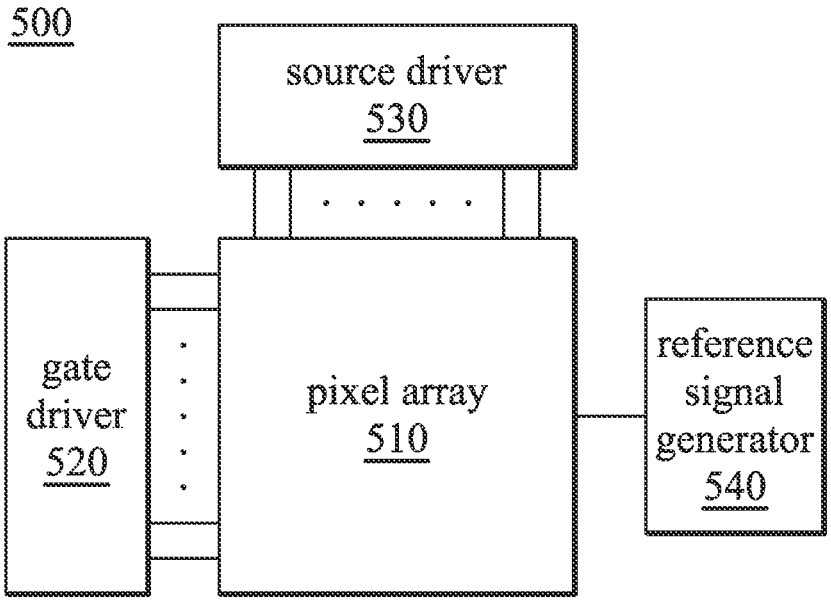
FIG. 5 illustrates an embodiment of the display panel.

FIG. 5 illustrates an embodiment of the display panel. As shown in FIG. 5, the display panel 500 comprises a pixel array 510, a gate driver 520, a source driver 530, and a reference signal generator 540. The pixel array 510 comprises pixel driving circuits, such as the embodiment of the pixel driving circuit 300 shown in FIG. 3.

The gate driver 520 provides scan signals (e.g. the scan signals SS1~SS3) to the pixel array 510 such that scan lines are asserted or de-asserted. The source driver 530 provides the data signals to the pixel driving circuits in the pixel array 510. The reference signal generator 540 provides the reference signals to the pixel driving circuits 300 in the pixel array 510, and can be integrated into the gate driver 520. Notably, the display panel 500 can be an organic light-emitting diode (OLED) display panel; however, various other technologies can be used in other embodiments.

Figure 6:
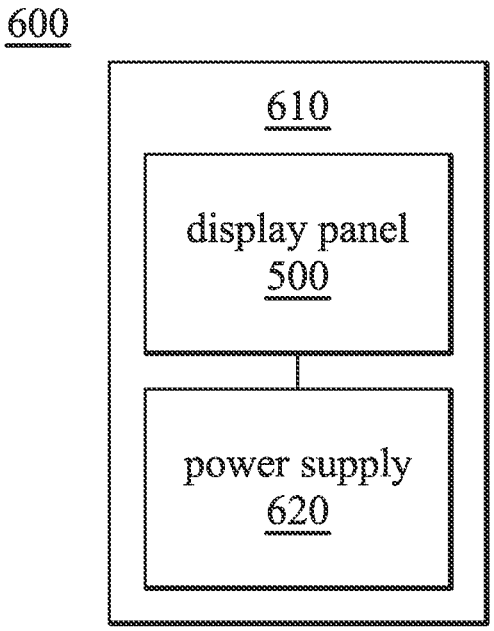
FIG. 6 illustrates an embodiment of the electronic device.

FIG. 6 illustrates an embodiment of the electronic device. In particular, the electronic device 600 employs the previously described display panel 500 of FIG. 5. The electronic device 600 may be a device such as a PDA, notebook computer, tablet computer, cellular phone, or a display monitor device, for example.

Generally, the electronic device 600 includes a housing 610, a display panel 500, and a power supply 620, although it is to be understood that various other components can be included; however, such other components are not shown or described here for ease of illustration and description. In operation, the power supply 620 powers the display panel 500 so that the display panel 500 can display images.

Figure 7:
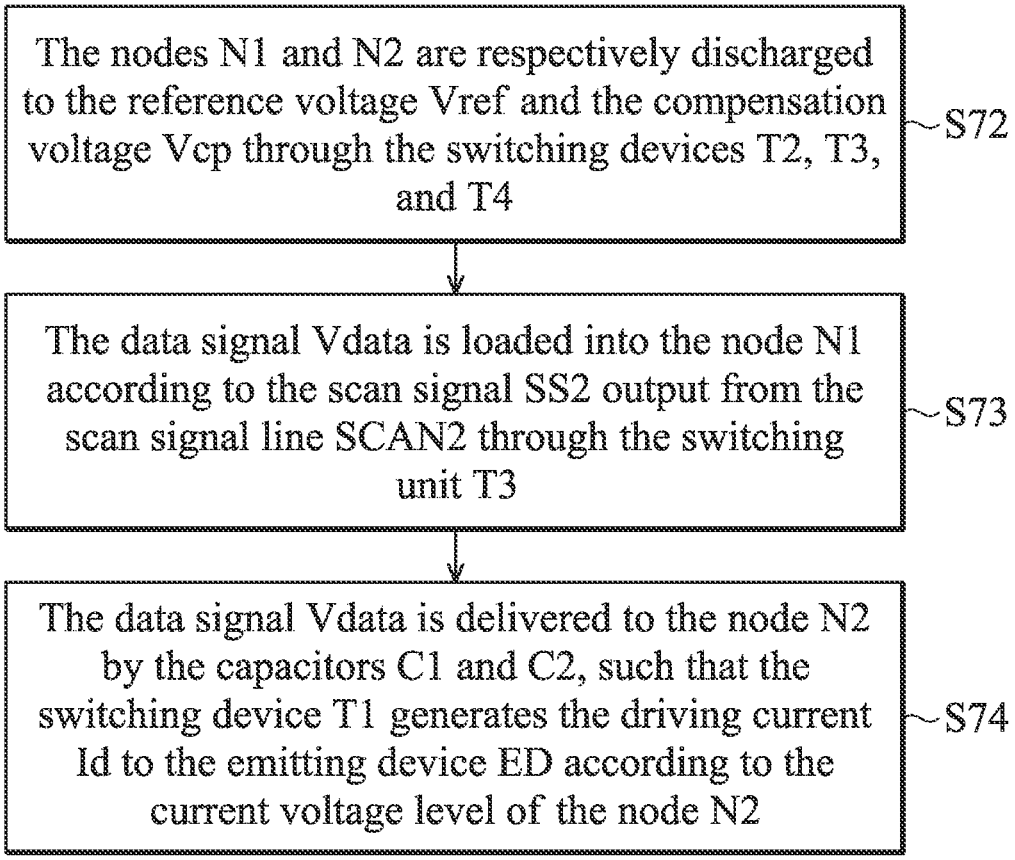
FIG. 7 illustrates a flowchart of the pixel driving method of the disclosure.

FIG. 7 illustrates a flowchart of the pixel driving method of the disclosure in which the pixel driving method is applied to the pixel array 510. Note that the whole pixels in the pixel array 510 operate together in the reset stage P1, the compensation stage P2, and the emission stage P4, but each row of the scan signal lines SCAN2 are sequentially enabled in the data input stage P3. As shown in FIG. 7, the procedure enters step S72 in the compensation stage P2, and the nodes N1 and N2 are respectively discharged to the reference voltage Vref and the compensation voltage Vcp through the switching devices T2, T3, and T4, in which the compensation voltage Vcp is the sum of the reference voltage Vref and the threshold voltage Vth of the switching device T1. The procedure enters step S73 in the data input stage P3 later than the compensation stage P2, and the data signal Vdata is loaded into the node N1 according to the scan signal SS2 output from the scan signal line SCAN2 through the switching device T3, in which the data signal Vdata is a negative voltage to protect the emitting device ED from being turned on in the data input stage P3 (i.e., Vcp=VOLED0+Vth).

The procedure enters step S74 in the emission stage P4 later than the data input stage P3, and the data signal Vdata is delivered to the node N2 by the capacitors C1 and C2, such that the switching device T1 generates the driving current Id to the emitting device ED according to the current voltage level of the node N2. Note that the whole pixels in the display panel 500 are reset and compensated for together by the pixel driving procedure of the disclosure. In other words, the pixel driving circuit 300 is a synchronous-compensation-type pixel driving circuit.

Figure 8:
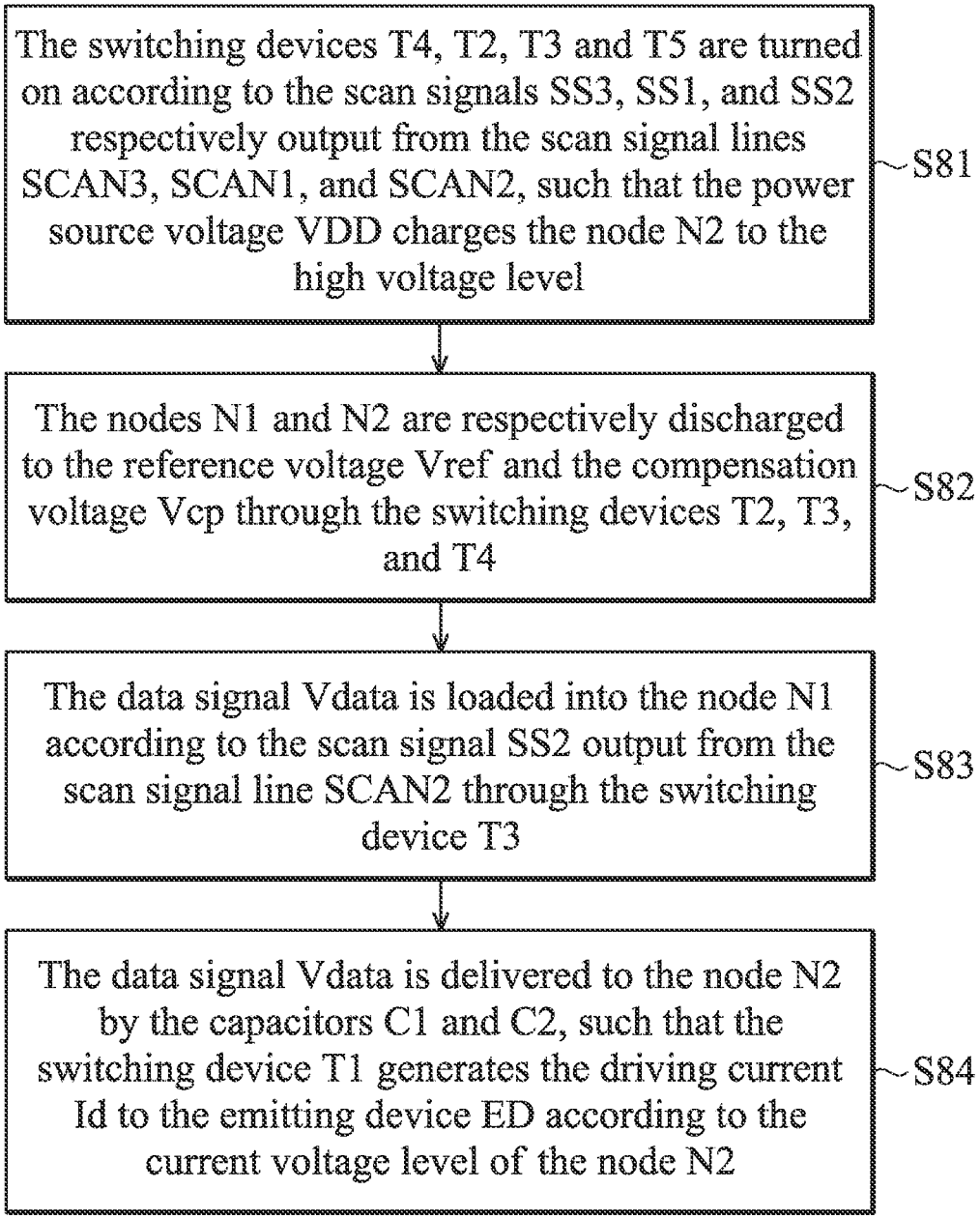
FIG. 8 illustrates another flowchart of the pixel driving method of the disclosure.

FIG. 8 illustrates another flowchart of the pixel driving method of the disclosure in which the pixel driving method is applied to the pixel array 510. As shown in FIG. 8, steps S82~S84 is equal to steps S72~S74. The procedure enters step S81 in the reset stage P1, and the switching devices T4, T2, T3 and T5 are turned on according to the scan signals SS3, SS1, and SS2 respectively output from the scan signal lines SCAN3, SCAN1, and SCAN2, such that the power source voltage VDD charges the node N2 to the high voltage level.

Figure 9:
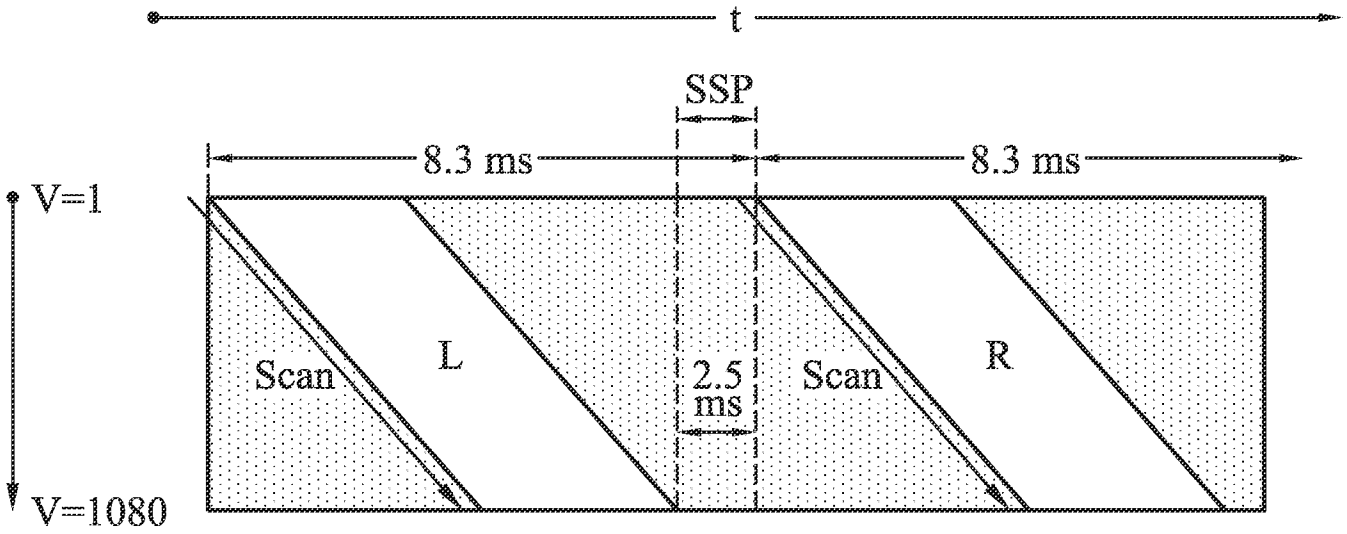
FIG. 9 is the timing chart of a progressive emission pixel driving circuit.
Figure 10:
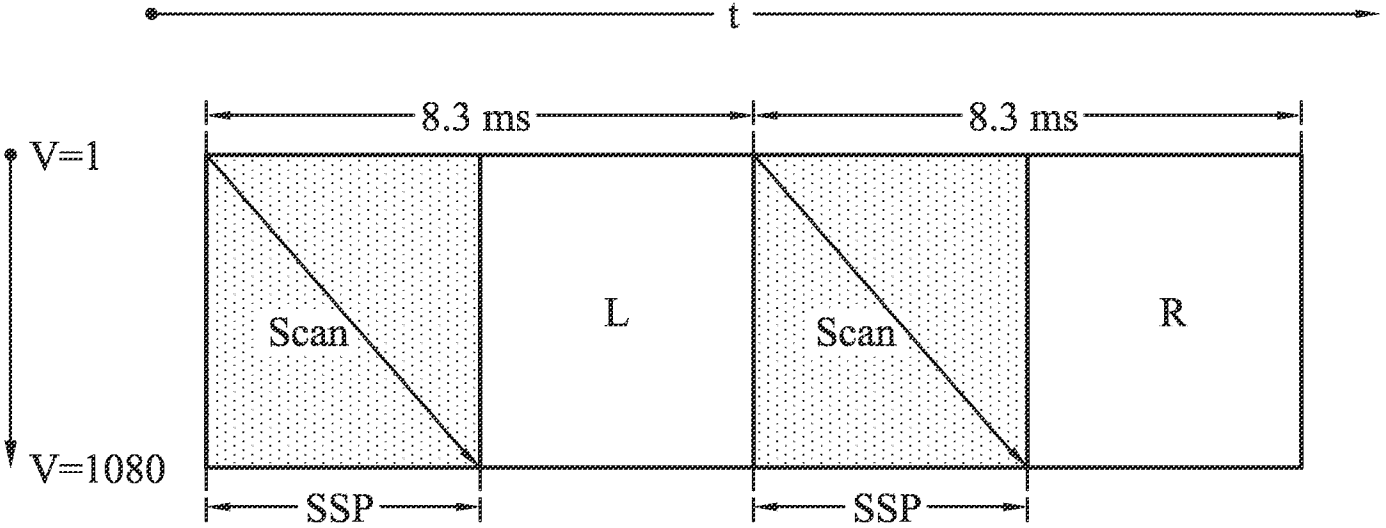
FIG. 10 is the timing chart of the embodiment of the pixel driving circuit.

FIG. 9 is the timing chart of a progressive-emission-type pixel driving circuit. FIG. 10 is the timing chart of the embodiment of the pixel driving circuit of the disclosure, in which R means the emission period of the right visual field, and L means the emission period of the left visual field. As shown in FIG. 9, each of the emission periods of the visual fields is about 4 ms, and the shutter switching period SSP (SSP means the time when the whole frames are in the blacking period) is about 2.5 ms. As shown in FIG. 10, since the pixel driving circuit of the disclosure is the synchronous-emission-type and synchronous-compensation-type pixel driving circuit, each of the emission periods of the visual fields is longer than 4 ms, and the shutter switching period SSP is about 4 ms. Compared with the progressive-emission-type pixel driving circuit, the blacking period of the pixel driving circuit of the disclosure is longer and is more helpful in switching the shutter in the shutter-glasses-type stereoscopic display device.

In conclusion, since the display panel 500 and the pixel driving circuit 300 are synchronous-emission-type pixel driving circuits, the emission period of the display panel 500 or the pixel driving circuit 300 is longer than the emission period of the progressive-emission-type pixel driving circuit. In addition, since the display panel 500 synchronously compensates for the threshold voltage variations of the whole pixels, the full screen blacking period of the display panel 500 is longer than the full screen blacking period of the progressive-emission-type pixel driving circuit, such that the shutter-glasses-type stereoscopic display device has enough time to switch the shutters in the black frame periods. Since any kinds of the N-type thin-film transistors can be adapted in the disclosure, the switching devices T1~T5 can be the InGaZnO thin-film transistors having high resolution, low power consumption, and high color saturation to drive the emission device ED. In addition, no matter how diverse the threshold voltage Vth shift of the switching device T1 in each pixel is, and no matter what the decay extent of the emission device ED in each pixel is, the display can maintain the best image quality for a long usage time.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A pixel driving circuit, comprising:

a first switching device, having a first terminal coupled to a first power source voltage, a second terminal, and a control terminal coupled to a first scan signal line;

a second switching device, having a first terminal coupled to the second terminal of the first switching device, a second terminal directly coupled to a first node and an emitting device, and a control terminal directly coupled to a second node;

a third switching device, having a first terminal coupled between the first terminal of the second switching device and the second terminal of the first switching device, a second terminal coupled directly to the second node, and a control terminal coupled to a second scan signal line;

a fourth switching device, having a first terminal coupled to a data signal line, a second terminal directly coupled to the first node, and a control terminal coupled to a third scan signal line;

a first capacitor, having a first terminal directly coupled to the first node and a second terminal directly coupled to a third node;

a second capacitor, having a first terminal directly coupled to the third node and a second terminal directly coupled to the second node; and a fifth switching device, having a first terminal directly coupled to the third node, a second terminal coupled to a second power source voltage, and a control terminal coupled to the third scan signal line.

2. The pixel driving circuit as claimed in claim 1, wherein, in a reset stage, the first switching device, the third switching device, the fourth switching device, and the fifth switching device operate in an on-state according to a first scan signal, a second scan signal, and a third scan signal output respectively from the first scan signal line, the second scan signal line, and the third scan signal line, such that the first switching device and the third switching device charge the second node to a high voltage level by the first power source voltage.

3. The pixel driving circuit as claimed in claim 2, wherein, in a compensation stage later than the reset stage, the third switching device, the fourth switching device, and the fifth switching device operate in the on-state according to the second scan signal and the third scan signal, and the first switching device operates in an off-state according to the first scan signal, such that the second switching device respectively discharges the first node and the second node to a reference voltage and a compensation voltage by the third switching device and the fourth switching device, wherein the compensation voltage is the sum of the reference voltage and a threshold voltage of the second switching device.

4. The pixel driving circuit as claimed in claim 3, wherein, in a data input stage later than the compensation stage, the fourth switching device and the fifth switching device operate in the on-state according to the third scan signal, and the first switching device, the second switching device and the third switching device operate in the off-state according to the first scan signal and the second scan signal, such that the fourth switching device loads a data signal into the first node, wherein the data signal is a negative voltage.

5. The pixel driving circuit as claimed in claim 4, wherein, in an emission state later than the data input stage, the third switching device, the fourth switching device and the fifth switching device operate in the off-state according to the second scan signal and the third scan signal, and the first switching device operates in the on-state according to the first scan signal, such that the first capacitor and the second capacitor deliver the data signal to the second node, and the second switching device generates a driving current to the emitting device according to the voltage level of the second node.

6. The pixel driving circuit as claimed in claim 5, wherein the level of the driving current is dependent on the reference voltage.

7. The pixel driving circuit as claimed in claim 1, wherein the first switching device, the second, third switching device, the fourth switching device, and the fifth switching device are N-type transistors.

8. A pixel driving method for a pixel driving circuit, wherein the pixel driving circuit comprises a first switching device, having a first terminal coupled to a first power source voltage, a second terminal, and a control terminal coupled to a first scan signal line;

a second switching device, having a first terminal coupled to the second terminal of the first switching device, a second terminal directly coupled to a first node and an emitting device, and a control terminal directly coupled to a second node;

a third switching device, having a first terminal coupled between the first terminal of the second switching device and the second terminal of the first switching device, a second terminal coupled directly to the second node, and a control terminal coupled to a second scan signal line;

a fourth switching device, having a first terminal coupled to a data signal line, a second terminal directly coupled to the first node, and a control terminal coupled to a third scan signal line;

a first capacitor, having a first terminal directly coupled to the first node and a second terminal directly coupled to a third node;

a second capacitor, having a first terminal directly coupled to the third node and a second terminal directly coupled to the second node; and a fifth switching device, having a first terminal directly coupled to the third node, a second terminal coupled to a second power source voltage, and a control terminal coupled to the third scan signal line, comprising:

respectively discharging the first node and the second node to a reference voltage and a compensation voltage through the second switching device, the third switching device, and the fourth switching device in a compensation stage, wherein the compensation voltage is the sum of the reference voltage and a threshold voltage of the second switching device;

loading a data signal into the first node through the fourth switching device according to a third scan signal output from the third scan signal line in a data input stage later than the compensation stage, wherein the data signal is a negative voltage; and delivering the data signal to the second node by the first capacitor and the second capacitor in an emission stage later than the data input stage, such that the second switching device generates a driving current to the emitting device according to the voltage level of the second node.

9. The pixel driving method as claimed in claim 8, further comprising:

turning on the first switching device, the third switching device, the fourth switching device, and the fifth switching device according to the third scan signal, and the first scan signal and the second scan signal output respectively from the first scan signal line and the second scan signal line in a reset stage earlier than the compensation stage, such that the first power source voltage charges the second node to a high voltage level.

10. The pixel driving method as claimed in claim 9, wherein the third switching device, the fourth switching device, and the fifth switching device are turned on according to the second scan signal and the third scan signal in the compensation stage, and the first switching device is turned off according to the first scan signal.

11. The pixel driving method as claimed in claim 10, wherein, in the data input stage, the fourth switching device and the fifth switching device are turned on according to the third scan signal, and the first switching device, the second switching device, and the third switching device are turned off according to the first scan signal and the second scan signal.

12. The pixel driving method as claimed in claim 11, wherein, in the emission stage, the third switching device, the fourth switching device and the fifth switching device are turned off according to the second scan signal and the third scan signal, and the first switching device is turned on according to the first scan signal.

13. The pixel driving method as claimed in claim 12, wherein the level of the driving current is dependent on the reference voltage.

14. The pixel driving method as claimed in claim 8, wherein the first switching device, the second switching device, the third switching device, the fourth switching device, and the fifth switching device are N-type transistors.

15. A display panel, comprising:

a pixel driving circuit, comprising:

a first switching device, having a first terminal coupled to a first power source voltage, a second terminal, and a control terminal coupled to a first scan signal line;

a second switching device, having a first terminal coupled to the second terminal of the first switching device, a second terminal directly coupled to a first node and an emitting device, and a control terminal directly coupled to a second node;

a third switching device, having a first terminal coupled between the first terminal of the second switching device and the second terminal of the first switching device, a second terminal coupled directly to the second node, and a control terminal coupled to a second scan signal line;

a fourth switching device, having a first terminal coupled to a data signal line, a second terminal directly coupled to the first node, and a control terminal coupled to a third scan signal line;

a first capacitor, having a first terminal directly coupled to the first node and a second terminal directly coupled to a third node;

a second capacitor, having a first terminal directly coupled to the third node and a second terminal directly coupled to the second node; and a fifth switching device, having a first terminal directly coupled to the third node, a second terminal coupled to a second power source voltage, and a control terminal coupled to the third scan signal line.

16. The display panel as claimed in claim 15, wherein, in a reset stage, the first switching device, the third switching device, the fourth switching device, and the fifth switching device operate in an on-state according to a first scan signal, a second scan signal, and a third scan signal respectively output from the first scan signal line, the second scan signal line, and the third scan signal line, such that the first switching device and the third switching device charge the second node to a high voltage level by the first power source voltage.

17. The display panel as claimed in claim 16, wherein, in a compensation stage later than the reset stage, the third switching device, the fourth switching device and the fifth switching device operate in the on-state according to the second scan signal and the third scan signal, and the first switching device operates in an off-state according to the first scan signal, such that the second switching device respectively discharges the first node and the second node to a reference voltage and a compensation voltage by the third switching device and the fourth switching device, wherein the compensation voltage is the sum of the reference voltage and a threshold voltage of the second switching device.

18. The display panel as claimed in claim 17, wherein, in a data input stage later than the compensation stage, the fourth switching device and the fifth switching device operate in the on-state according to the third scan signal, and the first switching device, the second switching device and the third switching device operate in the off-state according to the first scan signal and the second scan signal, such that the fourth switching device loads a data signal into the first node, wherein the data signal is a negative voltage.

19. The display panel as claimed in claim 18, wherein, in an emission state later than the data input stage, the third switching device, the fourth switching device, and the fifth switching device operate in the off-state according to the second scan signal and the third scan signals and the first switching device operates in the on-state according to the first scan signal, such that the first capacitor and the second capacitor deliver the data signal to the second node, and the second switching device generates a driving current to the emitting device according to the voltage level of the second node.

* * * * *

UNITED STATES PATENT AND TRADEMARK OFFICE

CERTIFICATE OF CORRECTION

PATENT NO. : 9,076,380 B2
APPLICATION NO. : 13/726841
DATED : July 7, 2015
INVENTOR(S) : Guo et al.

It is certified that error appears in the above-identified patent and that said Letters Patent is hereby corrected as shown below:

On the title page, item (54) and in the specification, column 1, line 1, the title should be "Pixel Driving Circuit, Pixel Driving Methods, Display Panels and Electronic Devices"

Signed and Sealed this
Twenty-fourth Day of November, 2015

Michelle K. Lee

Michelle K. Lee
*Director of the United States Patent and Trademark Office*